US011965412B1

(12) United States Patent
Deng et al.

(10) Patent No.: US 11,965,412 B1
(45) Date of Patent: Apr. 23, 2024

(54) QUANTITATIVE EVALUATION METHOD FOR INTEGRITY AND DAMAGE EVOLUTION OF CEMENT SHEATH IN OIL-GAS WELL

(71) Applicant: Southwest Petroleum University, Chengdu (CN)

(72) Inventors: Kuanhai Deng, Chengdu (CN); Niantao Zhou, Chengdu (CN); Yuanhua Lin, Chengdu (CN); Mingyuan Yao, Chengdu (CN); Ming Zhang, Chengdu (CN); Deqiang Yi, Chengdu (CN); Pengfei Xie, Chengdu (CN); Yang Peng, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 0 days.

(21) Appl. No.: 18/313,210

(22) Filed: May 5, 2023

(30) Foreign Application Priority Data

Dec. 2, 2022 (CN) ..... 202211542803.0

(51) Int. Cl.
*E21B 43/34* (2006.01)
*E21B 47/005* (2012.01)

(52) U.S. Cl.
CPC ..... *E21B 47/005* (2020.05)

(58) Field of Classification Search
CPC ..... E21B 47/005; E21B 43/34; C09K 8/34
USPC ..... 166/293
See application file for complete search history.

(56) References Cited

U.S. PATENT DOCUMENTS 10,150,904 B1 * 12/2018 Rahman ..... C04B 14/047
11,242,726 B2 * 2/2022 Toews ..... F24T 10/10
2011/0181701 A1 * 7/2011 Varslot ..... G06T 17/30 348/46
2013/0018641 A1 * 1/2013 Prisco ..... G01V 20/00 702/47

* cited by examiner

*Primary Examiner* — William D Hutton, Jr.
*Assistant Examiner* — Ashish K Varma
(74) *Attorney, Agent, or Firm* — Zhigang Ma

(57) ABSTRACT

A quantitative evaluation method for integrity and damage evolution of a cement sheath in an oil-gas well is provided based on a fractal theory, an image processing technology, structural features and failure mechanisms of a casing-cement sheath-formation combination. The method uses correlations among fractal dimensions of casing-cement sheath interface morphology, cement sheath microscopic pore morphology, particle morphology of an initial blank group, and macroscopic mechanical properties including a radial cementing strength of the cement sheath interface, a tensile strength, and a compressive strength to quantitatively evaluate the integrity of the cement sheath of the blank group. The method further uses correlations among fractal dimensions of the casing-cement sheath interface morphology, cement sheath microscopic pore morphology, particle morphology, crack morphology after an alternating load, and the macroscopic mechanical properties of the cement sheath to quantitatively evaluate a regularity of the damage evolution of the cement sheath of a conditional control group.

1 Claim, 5 Drawing Sheets

QUANTITATIVE EVALUATION METHOD FOR INTEGRITY AND DAMAGE EVOLUTION OF CEMENT SHEATH IN OIL-GAS WELL

TECHNICAL FIELD

The disclosure relates to the field of cement sheath integrity testing and evaluation for deep wells, ultra-deep wells, and deep shale gas horizontal wells, and particularly to a quantitative evaluation method for integrity and damage evolution of a cement sheath in an oil-gas well.

BACKGROUND

During a drilling process for oil and gas, purposes of well cementing are to isolate a formation, reinforce a wellbore, and construct an oil-gas-water flow channel with good sealing performance in a well to ensure the continuation of efficient and safe drilling, and ensure subsequent activities such as well testing, gas/water injection, fracturing, acidizing, and production be performed normally. To achieve the above purpose of well cementing, it is necessary for a cement sheath between the formation and an outer wall of a casing to maintain good integrity for a long time. Cement sheath integrity refers to the structural and functional integrity of the cement sheath during the service life in oil-gas wells.

Since deep oil-gas reservoirs, unconventional low-porosity oil-gas reservoirs, and low-permeability oil-gas reservoirs usually require large-scale hydraulic fracturing to obtain commercial oil and gas production. However, during a process of the large-scale hydraulic fracturing, fluctuations, continuous changes, and alternating loading and unloading of temperature and pressure can easily cause the integrity failure of a casing-cement sheath-formation combination. Integrity failure of the cement sheath can lead to multiple complex situations, such as sealing failure of layers, annular pressure, casing corrosion and short service life, and mutual channeling of oil, gas, and water outside the casing.

Research has found that the integrity failure of the cement sheath mainly includes two types: interface failure and cement sheath body failure. The Interface failure includes a first interface separation, a second interface separation, and an axial slippage, while the cement sheath body failure includes circumferential cracking, axial cracking and yield failure. Therefore, in order to prevent and control the integrity failure of the cement sheath, it is urgently needed to simulate a real downhole temperature and pressure, and operational characteristics to accurately and efficiently evaluate the integrity of the cement sheath, and based on the evaluation results, preventive and control measures are timely taken to ensure the quality and safety of the engineering and avoid similar accidents and risks, this is particularly important for safe and efficient production on site. At present, domestic and foreign scholars have conducted various researches on the mechanism of the integrity failure of the cement sheath and the integrity evaluation of the cement sheath based on theoretical and experimental methods, mainly including cementing strength of a casing-cement sheath interface, sealing performance, and integrity failure types. These researches are mainly based on a gas channeling principle, the gas channeling principle uses a destructive behavior of internal gas communication inside the cement sheath to evaluate the integrity of the cement sheath using a gas channeling evaluation instrument (such as FMA7150). However, it has been found that existing evaluation instruments and methods can only qualitatively evaluate the integrity of a cement sheath with large-scale microgaps, cracks, and channeling, but cannot be used for quantitative evaluation of a cement sheath without microgaps, cracks, and channeling. Furthermore, the destructive behavior of internal gas communication inside the cement sheath during an evaluation process cannot ensure the integrity of the cement sheath, thus affecting the accuracy of the evaluation results. On the contrary, on the premise of maintaining the integrity of the cement sheath, there are few reports about related methods and researches of quantitatively evaluating the integrity and damage evolution characteristics of the cement sheath under a simulated real working condition.

In recent years, with the development of deep wells, ultra-deep wells, and unconventional horizontal wells, the number of completed wells has been increased, oil-gas wells have characteristics of ultra-deep, ultra-high pressure, and high temperature, and the problem of the integrity the cement sheath is becoming more and more serious. In order to ensure that the cement sheath maintains good structural and functional integrity during the service life of oil-gas wells, and to prevent and control the integrity failure of the cement sheath, it is urgent to provide a new method for quantitatively evaluating the integrity of the cement sheath under a simulated working condition.

Therefore, the disclosure provides a quantitative evaluation method for integrity and damage evolution of a cement sheath in an oil-gas well based on a fractal theory, aiming to solve a technical problem that the integrity of the cement sheath is difficult to be quantitatively evaluated under a simulated working condition at present. The quantitative evaluation method can accurately obtain fractal dimensions of an interface of the cement sheath, cement sheath pore morphology, cement sheath particle morphology, and cement sheath crack morphology under a real working condition, and obtain correlations between these fractal dimensions and macroscopic mechanical properties. Based on the quantitative evaluation method, the integrity and a damage evolution law (also referred to as a regularity of damage evolution) of the cement sheath under alternating loads can be evaluated, and the quantitative evaluation method can provide support for an optimized design of a cement slurry system of the oil-gas well and quantitative evaluation of the integrity of the cement sheath.

SUMMARY

A purpose of the disclosure is to provide a quantitative evaluation method for integrity and damage evolution of a cement sheath in an oil-gas well, aiming to solve a technical problem that the integrity of the cement sheath is difficult to be quantitatively evaluated under a simulated working condition. The quantitative evaluation method is simple and practicable, and is fully applicable to the quantitative evaluation of the integrity of cement sheath in deep wells, ultra-deep wells, and unconventional oil-gas wells under an actual service condition.

In order to achieve the above purpose, the quantitative evaluation method for the integrity and the damage evolution of the cement sheath in the oil-gas well is provided by the disclosure. The quantitative evaluation method is mainly based on a fractal theory, an image processing technology, structural characteristics of a casing-cement sheath-formation combination, and a failure mechanism. The following principles are used to quantitatively evaluate the integrity and the damage evolution law of the cement sheath in the casing-cement sheath-formation combination: (1) the integrity of the cement sheath of a blank group is quantitatively evaluated by correlations among the fractal dimensions of the casing-cement sheath interface (the casing-cement sheath interface includes an outer wall of the casing in contact with the cement sheath and an inner wall of the cement sheath in contact with the casing), fractal dimensions of cement sheath pore morphology, fractal dimensions of cement sheath particle morphology and macroscopic mechanical properties of the cement sheath (The macroscopic mechanical properties include radial cementing strength of the cement sheath interface, tensile strength and compressive strength of the cement sheath); (2) the damage evolution of the cement sheath of a conditional control group is quantitatively evaluated by correlations among the fractal dimensions of the casing-cement sheath interface, fractal dimensions of cement sheath pore morphology, fractal dimensions of cement sheath particle morphology and macroscopic mechanical properties of the cement sheath. The technical solutions of the disclosure are as follows:

Step 1: preparing experimental samples for performing quantitative evaluation of the integrity and the damage evolution of the cement sheath; the step 1 includes:

(1) using a wellbore configuration and a cement slurry system, to simulate actual temperature and pressure to prepare casing-cement sheath-formation combinations; defining an outer wall of a casing in contact with the cement sheath as a target surface, and defining an inner wall of the cement sheath in contact with the casing as a contact surface;

(2) dividing the prepared casing-cement sheath-formation combinations into a blank group and a conditional control group, the blank group being used for quantitatively evaluating the integrity of the cement sheath without an alternating load and the conditional control group being used for quantitatively evaluating of a regularity of the damage evolution of the cement sheath with the alternating load;

(3) separating the cement sheath and the casing of the blank group, and using the cement sheath and the casing of the blank group to prepare a mechanical property test sample, a three-dimensional contour scanning sample of the target surface and the contact surface, a scanning electron microscope (SEM) scanning sample, and a mercury intrusion test sample; and (4) separating the cement sheath and the casing of the conditional control group, and using the cement sheath and the casing of the conditional control group to prepare a mechanical property test sample, a three-dimensional contour scanning sample of the target surface and the contact surface, a SEM scanning sample, and a mercury intrusion test sample.

Step 2: testing macroscopic mechanical properties of the cement sheath with the alternating load, and testing macroscopic mechanical properties of the cement sheath without the alternating load; the step 2 includes:

(1) using the casing-cement sheath-formation combinations of the blank group prepared in the step 1 to perform interface mechanical property tests, to obtain a radial cementing strength $S_{BR}$ of a casing-cement sheath interface of the blank group;

(2) using the mechanical property test sample of the blank group prepared in the step 1 to perform mechanical property tests, to obtain a tensile strength $Q_{BL}$ and a compressive strength $Q_{BC}$ of the cement sheath of the blank group;

(3) using the mechanical property test sample of the conditional control group prepared in the step 1 to perform mechanical property tests, to obtain obtaining a tensile strength $Q_{EL}$ and a compressive strength $Q_{EC}$ of the cement sheath of the conditional control group; and (4) using the casing-cement sheath-formation combinations of the conditional control group prepared in the step 1 to perform interface mechanical property tests, to obtain a radial cementing strength $S_{ER}$ of a casing-cement sheath interface of the conditional control group.

step 3: measuring and evaluating fractal dimensions of casing-cement sheath interface morphology with the alternating load, and measuring and evaluating fractal dimensions of the casing-cement sheath interface morphology without the alternating load; the step 3 includes:

(1) using an optical diffraction instrument to perform three-dimensional scans on the three-dimensional contour scanning sample of the target surface and the contact surface of the blank group and perform three-dimensional scans on the three-dimensional contour scanning sample of the target surface and the contact surface of the conditional control group prepared in the step 1, obtaining three-dimensional contour images of the target surfaces and the contact surfaces, and obtaining heights H of measurement points under different measurement sizes $\tau_{TF}$ and $\tau_{CF}$, where $\tau_{TF}$ represents a measurement size of the target surface and $\tau_{CF}$ represents a measurement size of the contact surface;

(2) using a structural-function-based fractal model $LgS(\tau_{TF})=lgC_{TF}+(4-2D_{TF\theta})Lg\tau_{TF}$ to draw the measurement size $\tau_{TF}$ of the target surface and a corresponding structural measurement function $S(\tau_{TF})$ on a double logarithmic coordinate system, $S(\tau_{TF})$ represents the corresponding structural measurement function of the target surface, $S(\tau_{TF})\ [H(Z+\tau_{TF}, \theta)-H(Z, \theta)]^2$, where Z represents a coordinate of measurement point data on the target surface along an axial direction of the casing, $\theta$ represents an angel of an angel coordinate of the measurement point data on the target surface along a circumferential direction of the casing, $\tau_{TF}$ represents the measurement size of the target surface, $H(Z+\tau_{TF}, \theta)$ represents a height of a measurement point $(Z+\tau_{TF}, \theta)$ in the three-dimensional contour image of the target surface; $H(Z, \theta)$ represents a height of a measurement point $(Z, \theta)$ in the three-dimensional contour image of the target surface; $C_{TF}$ represents a size coefficient of the target surface; and $D_{TF\theta}$ represents a fractal dimension of the target surface with the angle $\theta$;

(3) using a structural-function-based fractal model $LgS(\tau_{CF})=lgC_{CF}+(4-2D_{CF\alpha})Lg\tau_{CF}$ to draw the measurement size $\tau_{CF}$ of the contact surface and a corresponding structural measurement function $S(\tau_{CF})$ on the double logarithmic coordinate system, $S(\tau_{CF})$ represents the corresponding structural measurement function of the contact surface, $S(\tau_{CF})\ [H(Y+\tau_{CF}, \alpha)-H(Z, \alpha)]^2$, where Y represents a coordinate of measurement point data on the contact surface along an axial direction of the cement sheath, $\alpha$ represents an angel of an angel coordinate of the measurement point data on the contact surface along a circumferential direction of the cement sheath, $\tau_{CF}$ represents the measurement size of the contact surface, $H(Z+\tau_{CF}, \alpha)$ represents a height of a measurement point $(Y+\tau_{CF}, \alpha)$ in the three-dimensional contour image of the contact surface; $H(Y, \alpha)$ represents a height of a measurement point $(Y, \alpha)$ in the three-dimensional contour image of the contact surface; $C_{CF}$ represents a size coefficient of the contact surface; $D_{CF\alpha}$ represents a fractal dimension of the contact surface with the angel $\alpha$;

(4) calculating a fractal dimension of each of the target surfaces of the blank group and the conditional control group along directions of 0°, 90°, 180°, and 270° through a curve slope of the fractal model $LgS_{(TF)}=lgC_{TF}+(4-2D_{TF\theta})Lg\tau_{TF}$, taking an average value of $D_{TF0}$, $D_{TF90}$, $D_{TF180}$, and $D_{TF270}$ as the fractal dimension of the target surface; defining $D_{BTF}$ as the fractal dimension of the target surface of the blank group and defining $D_{ETF}$ as the fractal dimension of the target surface of the conditional control group; and (5) calculating a fractal dimension of each of the contact surfaces of the blank group and conditional control group along directions of 0°, 90°, 180°, and 270° through a curve slope of the fractal model $LgS(\tau_{CF})=lgC_{CF}+(4-2D_{CF\alpha})Lg\tau_{CF}$, taking an average value of $D_{CF0}$, $D_{CF90}$, $D_{CF180}$, and $D_{CF270}$ as the fractal dimension of the contact surface, defining $D_{BCF}$ as the fractal dimension of the contact surface of the blank group and defining $D_{ECF}$ as the fractal dimension of the contact surface of the conditional control group.

step 4: measuring and evaluating a fractal dimension of cement sheath pore morphology with the alternating load, and measuring and evaluating a fractal dimension of the cement sheath pore morphology without the alternating load; the step 4 includes:

(1) using a mercury intrusion method to perform mercury intrusion tests on the mercury intrusion test sample of the blank group and perform mercury intrusion tests on the mercury intrusion test sample of the conditional control group prepared in the step 1, obtaining true porosities $\varphi$ of the blank group and the conditional control group, obtaining total volumes $V_{Pi}$ of mercury entering cement sheath pores under different injection pressures Pi of the blank group and the conditional control group, and obtaining pore diameters 2Ri under the different injection pressures Pi of the blank group and the conditional control group;

(2) using a pore volume fractal model $Lg(|dV_{Pi}/dRi|)=(2-D_P)LgRi+C_P$ to draw an absolute value of an incremental ratio $|dV_{Pi}/dRi|$ between one of the total volumes $V_{Pi}$ and a pore radius on the double logarithmic coordinate system, where Ri represents the pore radius of the mercury intrusion test samples of the blank group and the conditional control group under a corresponding one of the different injection pressures Pi; $D_P$ represents the fractal dimension of the cement sheath pore morphology in the mercury intrusion test sample; $C_P$ represents a fractal model constant of the cement sheath pores of the mercury intrusion test sample; and (3) calculating the fractal dimensions of the cement sheath pore morphology of the blank group and the conditional control group through a curve slope of $Lg(|dVPi/dRi|)=(2-D_P)LgRi+C_P$, defining $D_{BP}$ as the fractal dimension of the cement sheath pore morphology of the blank group and defining $D_{Ep}$ as the fractal dimension of the cement sheath pore morphology of the conditional control group.

Step 5: measuring and evaluating a fractal dimension of cement sheath particle morphology with the alternating load, and measuring and evaluating a fractal dimension of the cement sheath particle morphology without the alternating load; the step 5 includes:

(1) using a scanning electron microscope to perform surface scanning on the SEM scanning samples of the blank group and the conditional control group prepared in the step 1, thereby obtaining SEM images of the cement sheaths the blank group and control group at different magnifications;

(2) using a program based on Python+OpenCV to binarize the SEM images, thereby obtaining binary images at different thresholds, white areas in the binary images representing microscopic particles, and black areas in the binary images representing microscopic pores;

(3) based on the true porosities $\varphi$ obtained by using the mercury intrusion method in the step 4, taking the true porosities $\varphi$ as a control factor and using a threshold segmentation algorithm based on an edge strength to adaptively adjust thresholds of the binary images, and selecting target binary images which have same true porosities with the SEM scanning samples of the blank group and the conditional control group;

(4) using a Matlab program to calculate areas and perimeters of white areas in the target binary images;

(5) using an area-perimeter fractal model $Lg(A_{Gi})=D_G*Lg(P_{Gi})+C_G$ to draw the areas and perimeters of the white areas in the target binary images on the double logarithmic coordinate system, where $P_{Gi}$ represents an equivalent perimeter of a white geometric figure in the target binary images, $A_{Gi}$ represents an equivalent area of the white geometric figure with the equivalent perimeter $P_{Gi}$ in the target binary images, $D_G$ represents the fractal dimension of the cement sheath particle morphology, and $C_G$ represents a fractal model constant of cement sheath particles; and (6) calculating the fractal dimension of the cement sheath particle morphology of each of the blank group and the conditional control group through a curve slope of $Lg(A_{Gi})=D_G*Lg(P_{Gi})+C_G$, defining $D_{BG}$ as the fractal dimension of the cement sheath particle morphology of the blank group and defining $D_{EG}$ as the fractal dimension of the cement sheath particle morphology of the conditional control group.

Step 6: measuring and evaluating fractal dimensions of cement sheath crack morphology after actions of the alternating load; the step 6 includes:

(1) using the scanning electron microscopy to perform surface scanning on the SEM scanning sample of the conditional control group prepared in the step 1, thereby obtaining SEM images of the cement sheath of the conditional control group at different magnifications;

(2) using a same method in the step 5 to obtain target binary images of cement sheath cracks;

(3) using a Matlab program to calculate a total number $N(\delta_{Fi})$ of square boxes with a side length $\delta_{Fi}$ covering the target binary images of the cement sheath cracks;

(4) using a box model $LgN(\delta_{Fi})=D_{EF}*Lg\delta_{Fi}+C_F$ to draw the side length $\delta_{Fi}$ and the total number $N(\delta_{Fi})$ of the square boxes on the double logarithmic coordinate system, where $D_{EF}$ represents the fractal dimension of the cement sheath crack morphology; $C_{EF}$ represents a fractal model constant of the cement sheath crack morphology; and (5) calculating the fractal dimension $D_{EF}$ of cement sheath crack morphology of the conditional control group through a curve slope of $LgN(\delta_{Fi})=D_{EF}*Lg\delta_{Fi}=C_{EF}$.

Step 7: based on the step 2 and the step 3, building functional relationships $F_{B1}(S_{BR}, D_{BTF})$ and $F_{B2}(S_{BR}, D_{BCF})$ between the radial cementing strength of the casing-cement sheath interface of the blank group and the fractal dimensions of the casing-cement sheath interface morphology of the blank group.

Step 8: based on the step 2 and the step 4, building functional relationships $F_{B3}(Q_{BL}, D_{BP})$ and $F_{B4}(Q_{BC}, D_{BP})$ between the macroscopic mechanical properties of the cement sheath of the blank group and the fractal dimension of the cement sheath pore morphology of the blank group.

Step 9: based on the step 2 and the step 5, building functional relationships $F_{B5}(Q_{BL}, D_{BG})$ and $F_{B6}(Q_{BC}, D_{BG})$ between the macroscopic mechanical properties of the cement sheath of the blank group and the fractal dimension of the cement sheath particle morphology of the blank group.

Step 10: based on the step 2 and the step 3, building functional relationships $F_{E1}(S_{ER}, D_{ETF})$ and $F_{E2}(S_{ER}, D_{ECF})$ between the radial cementing strength of the casing-cement sheath interface of the conditional control group and the fractal dimensions of the casing-cement sheath interface morphology of the conditional control group.

Step 11: based on the step 2 and the step 4, building functional relationships $F_{E3}(Q_{EL}, D_{EP})$ and $F_{E4}(Q_{EC}, D_{EP})$ between the macroscopic mechanical properties of the cement sheath of the conditional control group and the fractal dimension of the cement sheath pore morphology of the conditional control group.

Step 12: based on the step 2 and the step 5, building functional relationships $F_{E5}(Q_{EL}, D_{EG})$ and $F_{E6}(Q_{EC}, D_{EG})$ between the macroscopic mechanical properties of the cement sheath of the conditional control group and the fractal dimension of the cement sheath particle morphology of the conditional control group.

Step 13: based on the step 2 and the step 6, building functional relationships $F_{E7}(Q_{EL}, D_{EF})$ and $F_{E8}(Q_{EC}, D_{EF})$ between the macroscopic mechanical properties of the cement sheath of the conditional control group and the fractal dimension of the cement sheath crack morphology.

Step 14: using the fractal dimensions $D_{BTF}$, $D_{BCF}$, $D_{BP}$, $D_{BG}$ and the functional relationships $F_{B1}(S_{BR}, D_{BTF})$, $F_{B2}(S_{BR}, D_{BCF})$, $F_{B3}(Q_{BL}, D_{BP})$, $F_{B4}(Q_{BC}, D_{BP})$, $F_{B5}(Q_{BL}, D_{BG})$ and $F_{B6}(Q_{BC}, D_{BG})$ to quantitatively evaluate the integrity of the cement sheath of the blank group; and Step 15: using the fractal dimensions $D_{ETF}$, $D_{ECF}$, $D_{EP}$, $D_{EG}$, $D_{EF}$ and functional relationships $F_{E1}(S_{ER}, D_{ETF})$, $F_{E2}(S_{ER}, D_{ECF})$ $F_{E3}(Q_{EL}, D_{EP})$, $F_{E4}(Q_{EC}, D_{EP})$, $F_{E5}(Q_{EL}, D_{EG})$, $F_{E6}(Q_{EC}, D_{EG})$, $F_{E7}(Q_{EL}, D_{EF})$ and $F_{E8}(Q_{EC}, D_{EF})$ to quantitatively evaluate the regularity of the damage evolution of the cement sheath of the conditional control group.

The advantages of the disclosure are as follows:

Based on an analysis theory, a graphic processing technology, and a failure mechanism of the integrity of the cement sheath, correlations between the integrity of the cement sheath and microstructure morphology are accurately constructed, quantitative evaluation of integrity and damage evolution law of the cement sheath in the casing-cement sheath-formation combination under a simulated working condition, and it is better to prevent and control the integrity failure of the cement sheath. At the same time, it provides a new method for optimizing the design of cement slurry system and construction process parameters for oil-gas well cementing, as well as evaluating the integrity of the cement sheath.

DETAILED DESCRIPTION OF EMBODIMENTS

Figure 1:
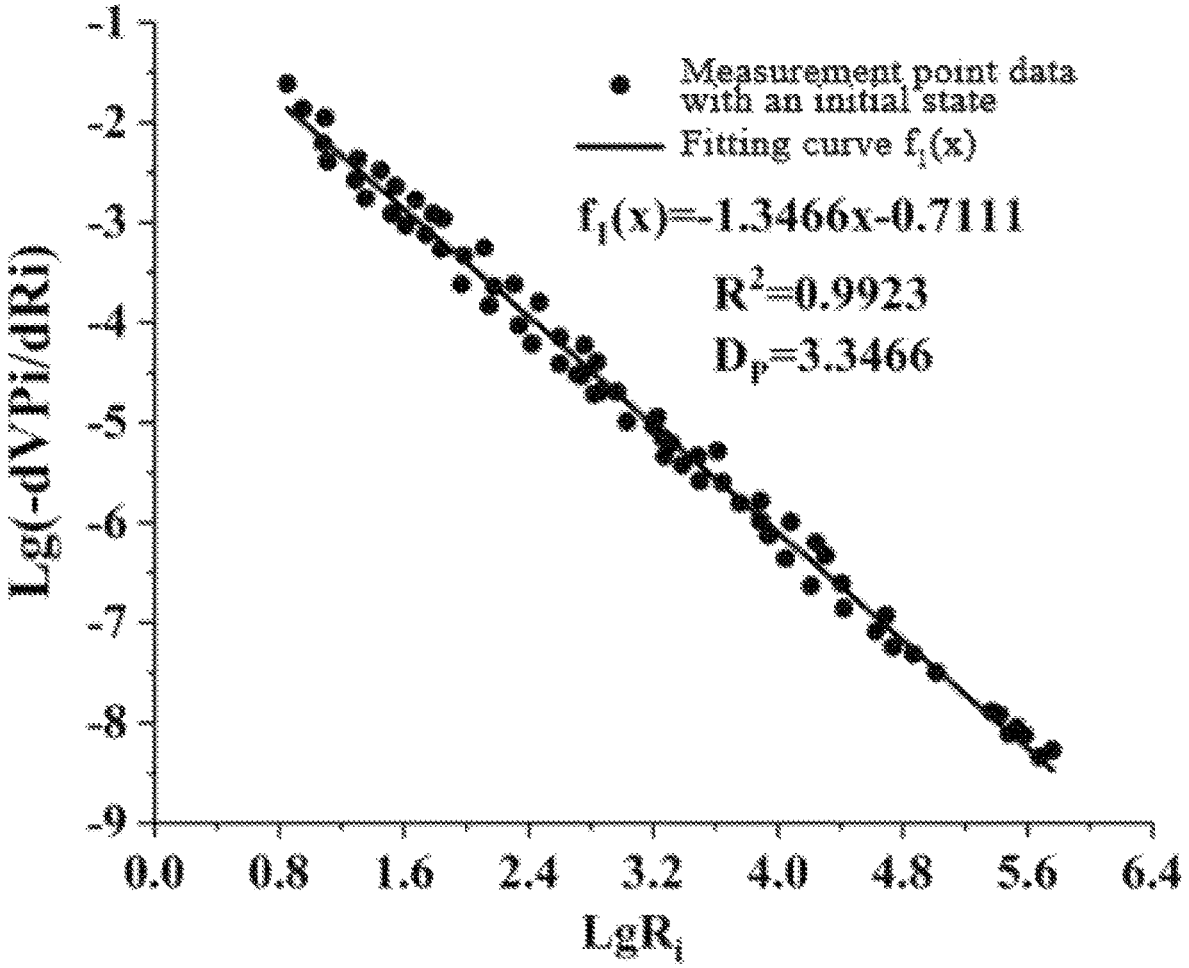
FIG. 1 illustrates a relationship curve between Lg|dVPi/dRi| and LgRi of cement sheath pores of a blank group.

The following is a detailed description of the disclosure in conjunction with the attached drawings and embodiments.

Referring to the attached drawings, the disclosure provides a quantitative evaluation method for integrity and damage evolution of a cement sheath in an oil-gas well. The method mainly includes the following steps:

Step 1: preparing experimental samples for performing quantitative evaluation of the integrity and the damage evolution of the cement sheath. The step 1 includes: (1) using a wellbore configuration and a cement slurry system of a well in the western oilfield of China, two groups (Group A and Group B) of casing-cement sheath-formation combinations are prepared under curing conditions of 120° C. and 35 MPa. Group A is a blank group, and Group B is a conditional control group obtained by loading alternating temperature actions of 30° C.→120° C.→30° C. for 10, 15, 20, and 25 cycles; (2) separating a cement sheath and a casing of the blank group, and using the cement sheath and the casing of the blank group to prepare a mechanical property test sample, a three-dimensional contour scanning sample of the target surface and the contact surface, a SEM scanning sample, and a mercury intrusion test sample; (3) separating a cement sheath and a casing of the conditional control group, and using the cement sheath and the casing of the conditional control group to prepare a mechanical property test sample, a three-dimensional contour test sample of the target surface and the contact surface, SEM scanning sample, and a mercury intrusion test sample.

Step 2: testing macroscopic mechanical properties of the cement sheath (i.e., the cement sheath of the conditional control group) with alternating temperature actions (30° C.→120° C.→30° C.), and testing the macroscopic mechanical properties of the cement sheath (i.e., the cement sheath of the blank group) without the alternating temperature actions (30° C.→120° C.→30° C.). The step 2 includes: (1) using the casing-cement sheath-formation combinations of the blank group prepared in the step 1 to perform interface mechanical property tests, to obtain a radial cementing strength $S_{BR}$ of a casing-cement sheath interface of the blank group; (2) using the mechanical property test sample of the blank group prepared in the step 1 to perform mechanical property tests, to obtain a tensile strength $Q_{BL}$ and a compressive strength $Q_{BC}$ of the cement sheath of the blank group; (3) using the mechanical property test sample of the conditional control group prepared in the step 1 to perform mechanical property tests, to obtain a tensile strength $Q_{EL}$ and a compressive strength $Q_{EC}$ of the cement sheath of the conditional control group; and; (4) using the casing-cement sheath-formation combinations of the conditional control group prepared in the step 1 to perform interface mechanical property tests, to obtain a radial cementing strength $S_{ER}$ of a casing-cement sheath interface of the conditional control group.

Step 3: measuring and evaluating fractal dimensions of casing-cement sheath interface morphology (also referred to as fractal dimensions of morphology of the casing-cement sheath interface) with the alternating temperature actions (30° C.→120° C.→30° C.), and measuring and evaluating fractal dimensions of the casing-cement sheath interface morphology without the alternating temperature actions (30° C.→120° C.→30° C.). The step 3 includes: (1) using an optical diffraction instrument to perform three-dimensional scans on the three-dimensional contour scanning sample of the target surface and the contact surface of the blank group and perform three-dimensional scans on the three-dimensional contour scanning sample of the target surface and the contact surface of the conditional control group prepared in the step 1, obtaining three-dimensional contour images of the target surfaces and the contact surfaces, and obtaining heights H of measurement points under different measurement sizes $\tau_{TF}$ and $\tau_{CF}$, where $\tau_{TF}$ represents a measurement size of the target surface, that is, $\tau_{TF}$ is axial spacing between two measurement point data, and $\tau_{CF}$ represents a measurement size of the contact surface, that is, $\tau_{CF}$ is axial spacing between two measurement point data; (2) using a structural-function-based fractal model $LgS(\tau_{TF})=lgC_{TF}+(4-2D_{TF\theta})Lg\tau_{TF}$ to draw the measurement size $\tau_{TF}$ of the target surface and a corresponding structural measurement function $S(\tau_{TF})$ on a double logarithmic coordinate system; (3) using a structural-function-based fractal model $LgS(\tau_{CF})=lgC_{CF}+(4-2D_{CF\alpha})Lg\tau_{CF}$ to draw the measurement size $\tau_{CF}$ of the contact surface and a corresponding structural measurement function $S(\tau_{CF})$ on the double logarithmic coordinate system; (4) calculating a fractal dimension of each of the target surfaces of the blank group and the conditional control group along directions of 0°, 90°, 180°, and 270° through a curve slope of the fractal model $LgS(\tau_{TF})=lgC_{TF}+(4-2D_{TF\theta})Lg\tau_{TF}$, taking an average value of $D_{TF0}$, $D_{TF90}$, $D_{TF180}$, and $D_{TF270}$ as the fractal dimension of the contact surface; defining $D_{BTF}$ as the fractal dimension of the target surface of the blank group, and defining $D_{ETF}$ as the fractal dimension of the target surface of the conditional control group; and (5) calculating a fractal dimension of each of the contact surfaces of the blank group and the conditional control group along directions of 0°, 90°, 180°, and 270° through a curve slope of the fractal model $LgS(\tau_{CF})=lgC_{CF}+(4-2D_{CF\alpha})Lg\tau_{CF}$, taking an average value of $D_{CF0}$, $D_{CF90}$, $D_{CF180}$, and $D_{CF270}$ as the fractal dimension of the contact surface, defining $D_{BCF}$ as the fractal dimension of the contact surface of the blank group, and defining $D_{ECF}$ as the fractal dimension of the contact surface of the conditional control group.

Figure 3:
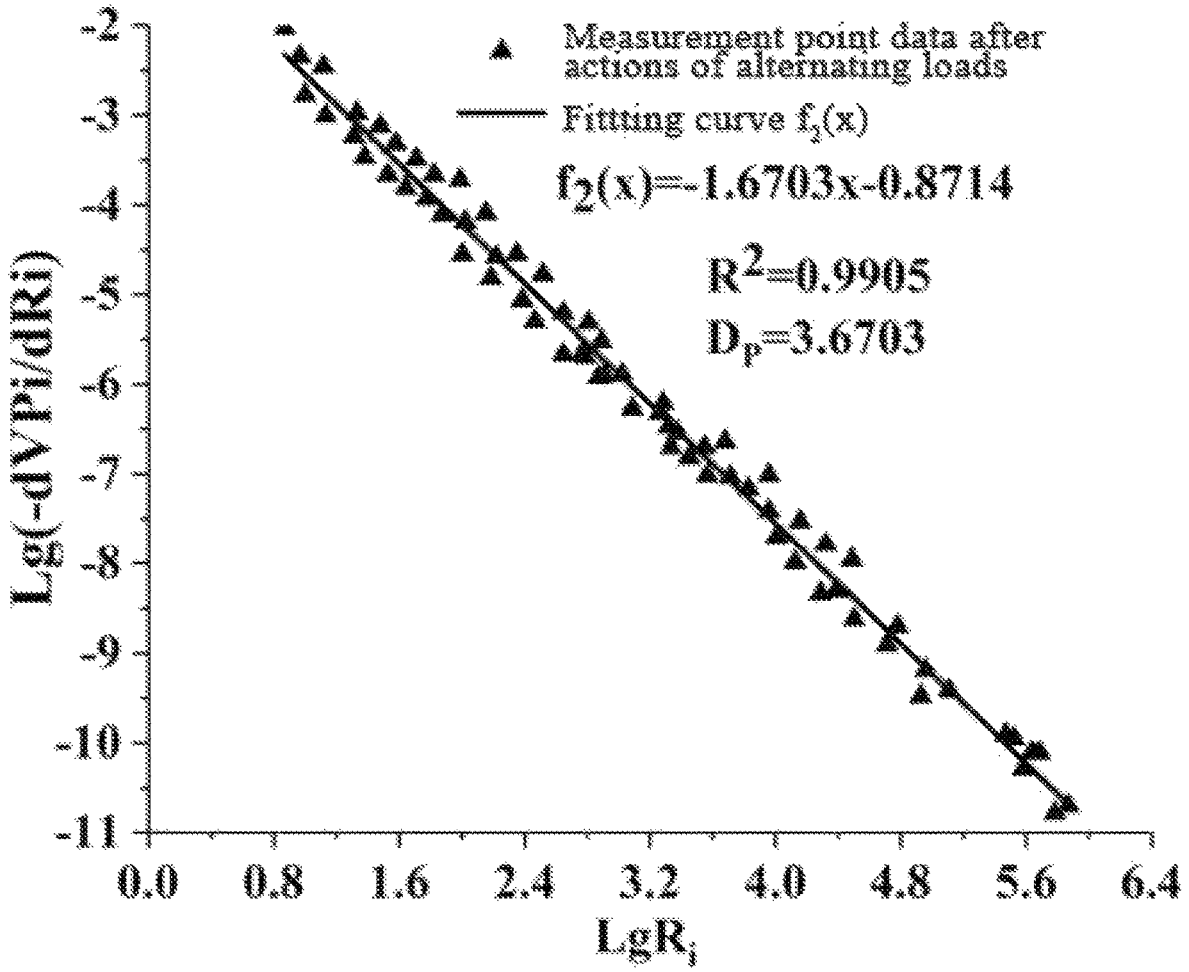
FIG. 3 illustrates a relationship curve between Lg|dVPi/dRi| and LgRi of the cement sheath pores after 15 cycles of alternating temperature actions.

Step 4: measuring and evaluating a fractal dimension of cement sheath pore morphology (also referred to as morphology of cement sheath pores) with the alternating temperature actions (30° C.→120° C.→30° C.), and measuring and evaluating the fractal dimensions of the cement sheath pore morphology without the alternating temperature actions (30° C.→120° C.→30° C.). The step 4 includes: (1) using a mercury intrusion method to perform mercury intrusion tests on the mercury intrusion test samples of the blank group and the conditional control group prepared in the step 1, obtaining true porosities φ of the blank group and the conditional control group, obtaining total volumes $V_{Pi}$ of mercury entering cement sheath pores under different injection pressures Pi, and obtaining pore diameters 2Ri under the different injection pressures Pi; (2) using a pore volume fractal model $Lg(|dV_{Pi}/dRi|)=(2-D_P)LgRi+C_P$ to draw an absolute value of an incremental ratio $|dV_{Pi}/dRi|$ between one of the total volumes $V_{Pi}$ and a pore radius on a double logarithmic coordinate system; (3) calculating the fractal dimension of the cement sheath pore morphology of the blank group and the fractal dimension of the cement sheath pore morphology of the conditional control group through a curve slope of $Lg(|dVPi/dRi|)=(2-D_P)LgRi+C_P$. FIG. 1 illustrates that $D_{BP}$ is 3.3466 as the fractal dimension of the cement sheath pore morphology of the blank group, and FIG. 3 illustrates that $D_{EP}$ is 3.6703 as the fractal dimension of the cement sheath pore morphology of the conditional control group.

Figure 2:
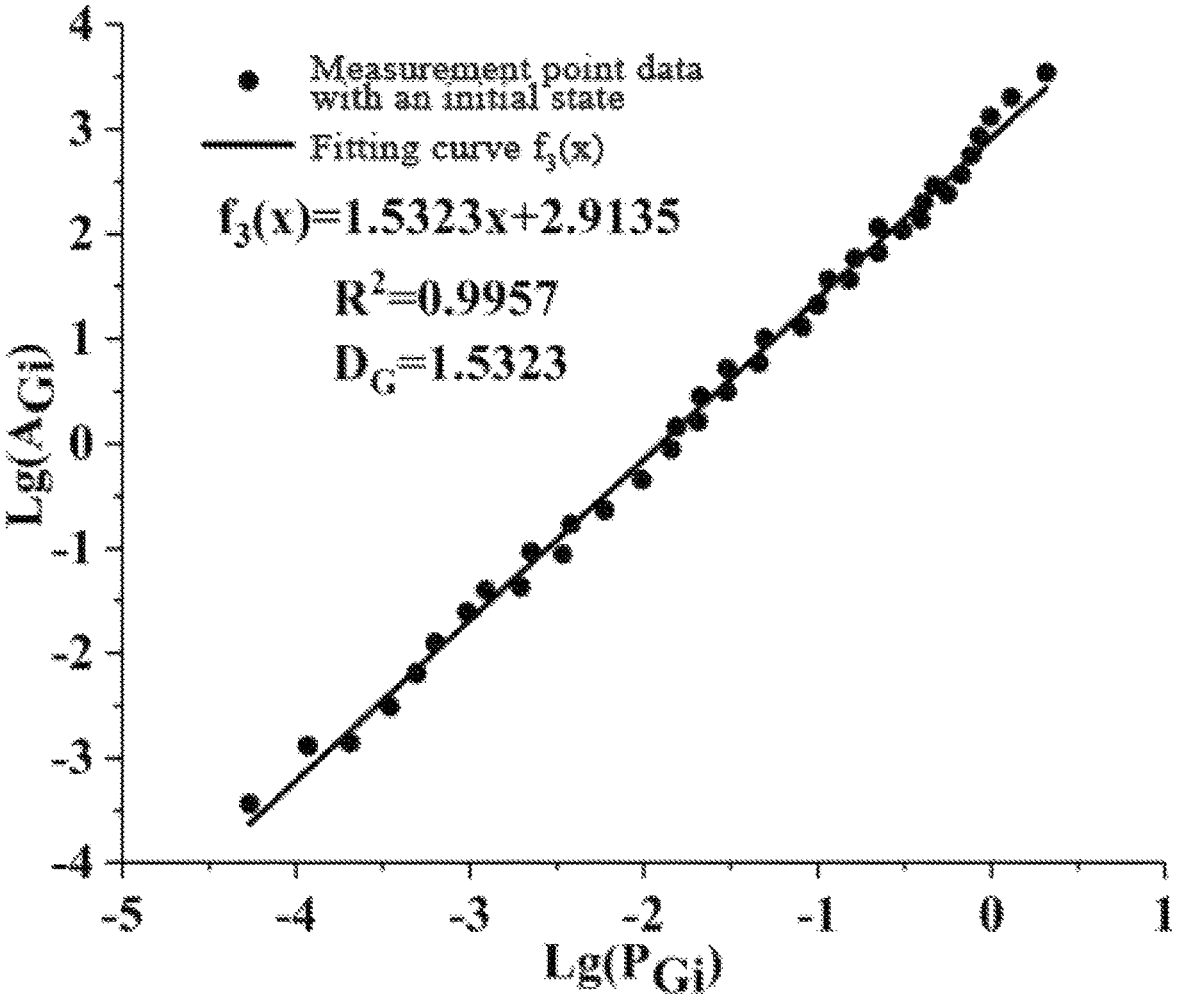
FIG. 2 illustrates a relationship curve between Lg(AGi) and Lg(PGi) of cement sheath particles of the bland group.
Figure 4:
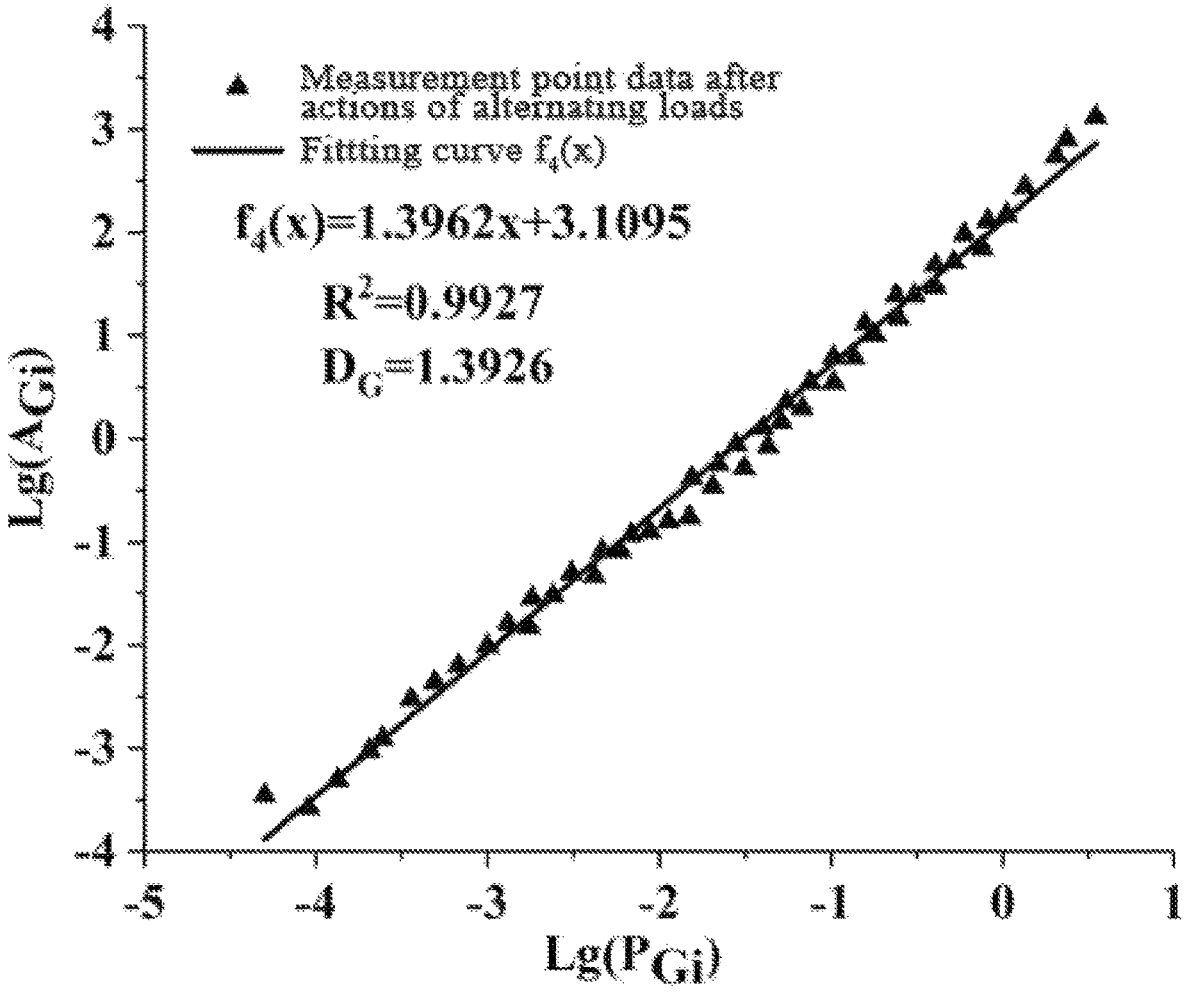
FIG. 4 illustrates a relationship curve between Lg(AGi) and Lg(PGi) of the cement sheath pores after 15 cycles of alternating temperature actions.

Step 5: measuring and evaluating fractal dimensions of cement sheath particle morphology with the alternating temperature actions (30° C.→120° C.→30° C.), and measuring and evaluating fractal dimensions of the cement sheath particle morphology without the alternating temperature actions (30° C.→120° C.→30° C.). The step 5 includes: (1) using a scanning electron microscope to perform surface scanning on the SEM scanning samples of the blank group and the conditional control group prepared in the step 1, thereby obtaining SEM images of the cement sheaths of the blank group and control group at different magnifications; (2) using a program based on Python+OpenCV to binarize the SEM images, thereby obtaining binary images at different thresholds, white areas in the binary images represent microscopic particles, and black areas in the binary images represent microscopic pores; (3) based on the true porosities φ obtained by using the mercury intrusion method in the step 4, taking the true porosities φ as a control factor and using a threshold segmentation algorithm based on edge strength to adaptively adjust thresholds of the binary images, and selecting target binary images which have same true porosities with the SEM scanning samples of the blank group and the conditional control group; (4) using a Matlab program to calculate areas and perimeters of white areas in the target binary images; (5) using an area-perimeter fractal model $Lg(A_{Gi})=D_G*Lg(P_{Gi})+C_G$ to draw the areas and perimeters of the white areas in the target binary images on the double logarithmic coordinate system; and (6) calculating the fractal dimension of the cement sheath particle morphology of each of the blank group and the conditional control group through a curve slope of $Lg(A_{Gi})=D_G*Lg(P_{Gi})+C_G$. FIG. 2 illustrates that $D_{BG}$ is 1.532 as the fractal dimension of the cement sheath particle morphology of the blank group, and FIG. 4 illustrates that $D_{EG}$ is 1.3926 as the fractal dimension of the cement sheath particle morphology of the conditional control group after 15 cycles of alternating temperature actions.

Step 6: measuring and evaluating a fractal dimension of cement sheath crack morphology (also referred to as morphology of cement sheath cracks) after the alternating temperature actions. The step 6 includes: (1) using the scanning electron microscopy to perform surface scanning on the SEM scanning sample of the conditional control group prepared in the step 1, thereby obtaining SEM images of the cement sheath of the conditional control group at different magnifications; (2) using a same method in the step 5 to obtain target binary images of cement sheath cracks; (3) using a Matlab program to calculate a total number N(Fi) of square boxes with a side length $\delta_{Fi}$ covering the target binary images of the cement sheath cracks; (4) using a box model $LgN(\delta_{Fi})=D_{EF}*Lg\delta_{Fi}+C_F$ to draw the side length $\delta_{Fi}$ and the total number $N(\delta_{Fi})$ of the square boxes on the double logarithmic coordinate system; and (5) calculating the fractal dimension $D_{EF}$ of cement sheath crack morphology the conditional control group through a curve slope of $LgN(\delta_{Fi})=D_{EF}*Lg\delta_{Fi}+C_{EF}$.

Step 7: based on the step 2 and the step 3, building functional relationships $F_{B1}(S_{BR}, D_{BTF})$ and $F_{B2}(S_{BR}, D_{BCF})$ between the radial cementing strength of the casing-cement sheath interface of the blank group and the fractal dimensions (i.e., and i.e., the fractal dimension $D_{BTF}$ of target surface of the blank control group and the fractal dimension $D_{BCF}$ of the contact surface of the blank group) of the casing-cement sheath interface morphology of the blank group.

Step 8: based on the step 2 and the step 4, building functional relationships $F_{B3}(Q_{BL}, D_{BP})$ and $F_{B4}(Q_{BC}, D_{BP})$ between the macroscopic mechanical properties of the cement sheath of the blank group and the fractal dimension of the cement sheath pore morphology of the blank group.

Step 9: based on the step 2 and the step 5, building functional relationships $F_{B5}(Q_{BL}, D_{BG})$ and $F_{B6}(Q_{BC}, D_{BG})$ between the macroscopic mechanical properties of the cement sheath of the blank group and the fractal dimension of the cement sheath particle morphology of the blank group.

Step 10: based on the step 2 and the step 3, building functional relationships $F_{E1}(S_{ER}, D_{ETF})$ and $F_{E2}(S_{ER}, D_{ECF})$ between the radial cementing strength of the casing-cement sheath interface of the conditional control group and the fractal dimensions (i.e., the fractal dimension $D_{ETF}$ of target surface of the conditional control group and the fractal dimension $D_{ECF}$ of the contact surface of the conditional control group) of the casing-cement sheath interface morphology of the conditional control group.

Step 11: based on the step 2 and the step 4, building functional relationships $F_{E3}(Q_{EL}, D_{EP})$ and $F_{E4}(Q_{EC}, D_{EP})$ between the macroscopic mechanical properties of the cement sheath of the conditional control group and the fractal dimension of the cement sheath pore morphology of the conditional control group.

Step 12: based on the step 2 and the step 5, building functional relationships $F_{E5}(Q_{EL}, D_{EG})$ and $F_{E6}(Q_{EC}, D_{EG})$ between the macroscopic mechanical properties of the cement sheath of the conditional control group and the fractal dimension of the cement sheath particle morphology of the conditional control group.

Step 13: based on the step 2 and the step 6, building functional relationships $F_{E7}(Q_{EL}, D_{EF})$ and $F_{E8}(Q_{EC}, D_{EF})$ between the macroscopic mechanical properties of the cement sheath of the conditional control group and the fractal dimensions of the cement sheath crack morphology.

Step 14: using the fractal dimensions $D_{BTF}$, $D_{BCF}$, $D_{BP}$, $D_{BG}$ and the functional relationships $F_{B1}(S_{BR}, D_{BTF})$, $F_{B2}(S_{BR}, D_{BCF})$, $F_{B3}(Q_{BL}, D_{BP})$, $F_{B4}(Q_{BC}, D_{BP})$, $F_{B5}(Q_{BL}, D_{BG})$ and $F_{B6}(Q_{BC}, D_{BG})$ to quantitatively evaluate the integrity of the cement sheath of the blank group.

Step 15: using the fractal dimensions $D_{ETF}$, $D_{ECF}$, $D_{EP}$, $D_{EG}$, $D_{EF}$ and functional relationships $F_{E1}(S_{ER}, D_{ETF})$, $F_{E2}(S_{ER}, D_{ECF})$ $F_{E3}(Q_{EL}, D_{EP})$, $F_{E4}(Q_{EC}, D_{EP})$, $F_{E5}(Q_{EL}, D_{EG})$, $F_{E6}(Q_{EC}, D_{EG})$, $F_{E7}(Q_{EL}, D_{EF})$ and $F_{E8}(Q_{EC}, D_{EF})$ to quantitatively evaluate the damage evolution law of the cement sheath of the conditional control group.

Figure 5:
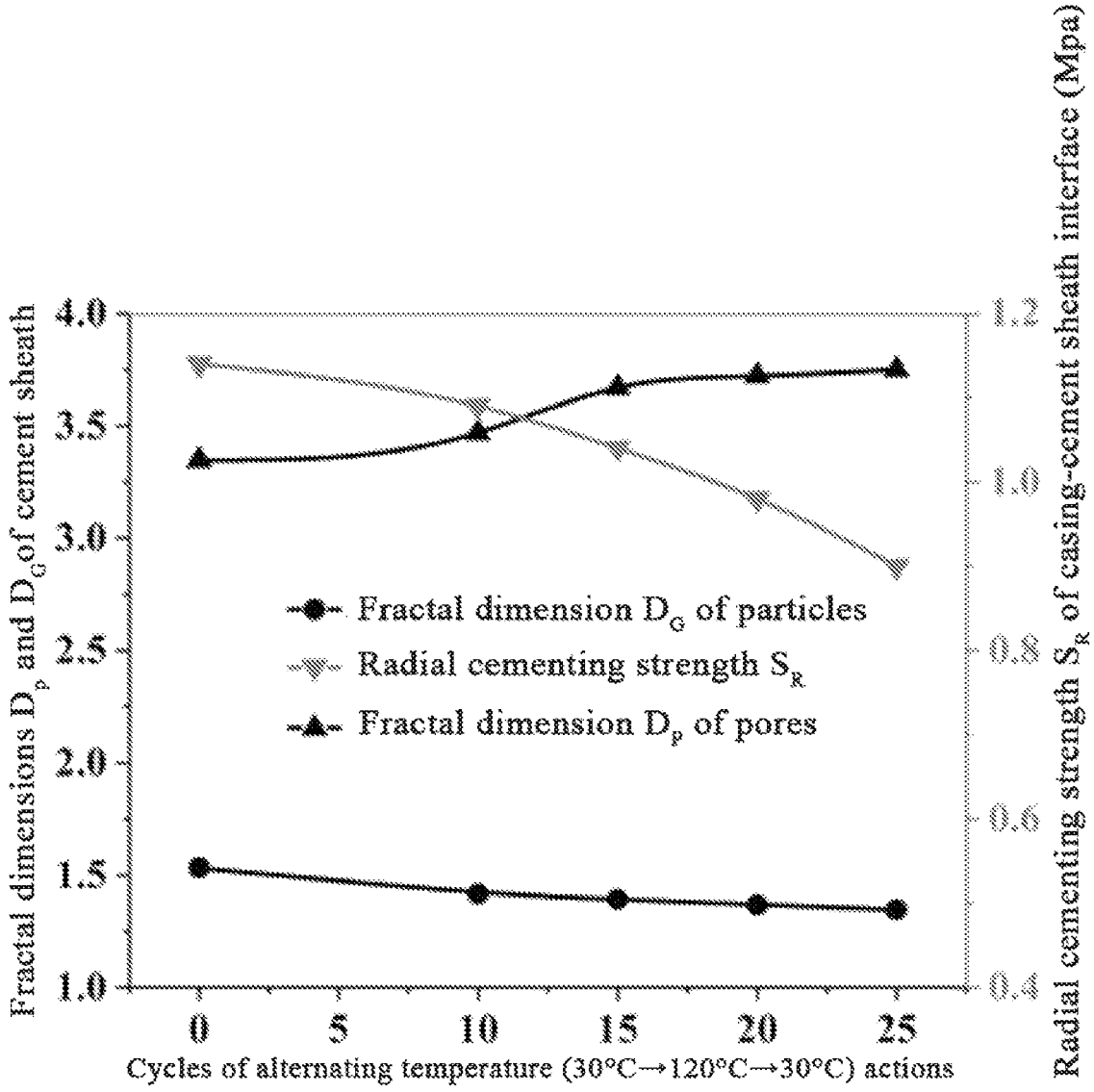
FIG. 5 illustrates fractal dimensions of cement sheath pore morphology and cement sheath particle morphology of the cement sheath after different cycles of alternating temperature actions.

FIG. 5 illustrates that the radial cementing strength of the casing-cement sheath interface is closely related to the fractal dimensions of cement sheath pore morphology and cement sheath particle morphology. As the number of alternating temperature cycles increases, the radial cementing strength of the casing-cement sheath interface $S_R$ gradually decreases, leading to the cement sheath being more prone to interface failures and the formation of micro-annulus. The corresponding fractal dimension $D_P$ of the cement sheath pore morphology increases, mainly due to the increase in porosity, deterioration of pore structure, and more complex distribution caused by the alternating temperature actions. The corresponding fractal dimension $D_G$ of the cement sheath particle morphology decreases, mainly due to the loose arrangement structure of particles caused by the alternating temperature actions. The microscopic structural changes in these two aspects lead to the deterioration of the macroscopic mechanical properties of the cement sheath.

What is claimed is:

1. A quantitative evaluation method for integrity and damage evolution of a cement sheath in an oil-gas well, comprising:

preparing experimental samples in order to perform quantitative evaluation of the integrity and the damage evolution of the cement sheath, comprising:

utilizing a wellbore configuration and a cement slurry system to simulate actual temperature and pressure to prepare casing-cement sheath-formation combinations;

defining an outer wall of a casing in contact with the cement sheath as a target surface, and defining an inner wall of the cement sheath in contact with the casing as a contact surface;

dividing the prepared casing-cement sheath-formation combinations into a blank group and a conditional control group, the blank group being used for quantitatively evaluating the integrity of the cement sheath without an alternating load and the conditional control group being used for quantitatively evaluating of a regularity of the damage evolution of the cement sheath with the alternating load;

separating the cement sheath and the casing of the blank group, and using the cement sheath and the casing of the blank group to prepare a mechanical property test sample, a three-dimensional contour scanning sample of the target surface and the contact surface, a scanning electron microscope (SEM) scanning sample, and a mercury intrusion test sample; and separating the cement sheath and the casing of the conditional control group, and using the cement sheath and the casing of the conditional control group to prepare a mechanical property test sample, a three-dimensional contour scanning sample of the target surface and the contact surface, a SEM scanning sample, and a mercury intrusion test sample;

testing macroscopic mechanical properties of the cement sheath with the alternating load, and testing macroscopic mechanical properties of the cement sheath without the alternating load, comprising:

performing interface mechanical property tests to obtain a radial cementing strength $S_{BR}$ of a casing-cement sheath interface of the blank group;

performing mechanical property tests to obtain a tensile strength $Q_{BL}$ and a compressive strength $Q_{BC}$ of the cement sheath of the blank group;

performing mechanical property tests to obtain obtaining a tensile strength $Q_{EL}$ and a compressive strength $Q_{EC}$ of the cement sheath of the conditional control group; and performing interface mechanical property tests to obtain a radial cementing strength $S_{ER}$ of a casing-cement sheath interface of the conditional control group;

measuring and evaluating fractal dimensions of casing-cement sheath interface morphology with the alternating load, and measuring and evaluating fractal dimensions of the casing-cement sheath interface morphology without the alternating load, comprising:

utilizing an optical diffraction instrument to perform three-dimensional scans on the three-dimensional contour scanning sample of the target surface and the contact surface of the blank group and perform three-dimensional scans on the three-dimensional contour scanning sample of the target surface and the contact surface of the conditional control group, obtaining three-dimensional contour images of the target surfaces and the contact surfaces, and obtaining heights H of measurement points under different measurement sizes $\tau_{TF}$ and $\tau_{CF}$, where $\tau_{TF}$ represents a measurement size of the target surface and $\tau_{CF}$ represents a measurement size of the contact surface;

utilizing a structural-function-based fractal model $LgS(\tau_{TF})=lgC_{TF}+(4-2D_{TF\theta})Lg\tau_{TF}$ to draw the measurement size $\tau_{TF}$ of the target surface and a corresponding structural measurement function $S(\tau_{TF})$ on a double logarithmic coordinate system, $S(\tau_{TF})$ represents the corresponding structural measurement function of the target surface, $S(\tau_{TF})=[H(Z+\tau_{TF}, \theta)-H(Z, \theta)]^2$, where Z represents a coordinate of measurement point data on the target surface along an axial direction of the casing, $\theta$ represents an angel of an angel coordinate of the measurement point data on the target surface along a circumferential direction of the casing, $\tau_{TF}$ represents the measurement size of the target surface, $H(Z+\tau_{TF}, \theta)$ represents a height of a measurement point $(Z+\tau_{TF}, \theta)$ in the three-dimensional contour image of the target surface; $H(Z, \theta)$ represents a height of a measurement point $(Z, \theta)$ in the three-dimensional contour image of the target surface; $C_{TF}$ represents a size coefficient of the target surface; and $D_{TF}$ represents a fractal dimension of the target surface with the angle $\theta$;

utilizing a structural-function-based fractal model $LgS(\tau_{CF})=lgC_{CF}+(4-2D_{CF\alpha})Lg\tau_{CF}$ to draw the measurement size $\tau_{CF}$ of the contact surface and a corresponding structural measurement function $S(\tau_{CF})$ on the double logarithmic coordinate system, $S(\tau_{CF})$ represents the corresponding structural measurement function of the contact surface, $S(\tau_{CF})=[H(Y+\tau_{CF}, \alpha)-H(Z, \alpha)]^2$, where Y represents a coordinate of measurement point data on the contact surface along an axial direction of the cement sheath, $\alpha$ represents an angel of an angel coordinate of the measurement point data on the contact surface along a circumferential direction of the cement sheath, $\tau_{CF}$ represents the measurement size of the contact surface, $H(Z+\tau_{CF}, \alpha)$ represents a height of a measurement point $(Y+\tau_{CF}, \alpha)$ in the three-dimensional contour image of the contact surface; $H(Y, \alpha)$ represents a height of a measurement point $(Y, \alpha)$ in the three-dimensional contour image of the contact surface; $C_{CF}$ represents a size coefficient of the contact surface; $D_{CF\alpha}$ represents a fractal dimension of the contact surface with the angel $\alpha$;

calculating a fractal dimension of each of the target surfaces of the blank group and the conditional control group along directions of 0°, 90°, 180°, and 270° through a curve slope of the fractal model $LgS(\tau_{TF})=lgC_{TF}+(4-2D_{TF\theta})Lg\tau_{TF}$, taking an average value of $D_{TF0}$, $D_{TF90}$, $D_{TF180}$, and $D_{TF270}$ as the fractal dimension of the target surface; defining $D_{BTF}$ as the fractal dimension of the target surface of the blank group, and defining $D_{ETF}$ as the fractal dimension of the target surface of the conditional control group; and calculating a fractal dimension of each of the contact surfaces of the blank group and the conditional control group along directions of 0°, 90°, 180°, and 270° through a curve slope of the fractal model $LgS(\tau_{CF})=lgC_{CF}+(4-2D_{CF\alpha})Lg\tau_{CF}$, taking an average value of $D_{CF0}$, $D_{CF90}$, $D_{CF180}$, and $D_{CF270}$ as the fractal dimension of the contact surface, defining $D_{BCF}$ as the fractal dimension of the contact surface of the blank group, and defining $D_{EC}F$ as the fractal dimension of the contact surface of the conditional control group;

measuring and evaluating a fractal dimension of cement sheath pore morphology with the alternating load, and measuring and evaluating a fractal dimension of the cement sheath pore morphology without the alternating load, comprising:

utilizing a mercury intrusion method to perform mercury intrusion tests on the mercury intrusion test sample of the blank group and perform mercury intrusion tests on the mercury intrusion test sample of the conditional control group, obtaining true porosities $\varphi$ of the blank group and the conditional control group, obtaining total volumes $V_{Pi}$ of mercury entering cement sheath pores under different injection pressures Pi of the blank group and the conditional control group, and obtaining pore diameters 2Ri under the different injection pressures Pi of the blank group and the conditional control group;

utilizing a pore volume fractal model $Lg(|dV_{Pi}/dRi|)=(2-D_P)LgRi+C_P$ to draw an absolute value of an incremental ratio $|dV_{Pi}/dRi|$ between one of the total volumes $V_{Pi}$ and a pore radius on the double logarithmic coordinate system, where Ri represents the pore radius of the mercury intrusion test samples of the blank group and the conditional control group under a corresponding one of the different injection pressures Pi; $D_P$ represents the fractal dimension of the cement sheath pore morphology in the mercury intrusion test sample; $C_P$ represents a fractal model constant of the cement sheath pores of the mercury intrusion test sample; and calculating the fractal dimensions of the cement sheath pore morphology of the blank group and the conditional control group through a curve slope of $Lg(|dVPi/dRi|)=(2-D_P)LgRi+C_P$, defining $D_{BP}$ as the fractal dimension of the cement sheath pore morphology of the blank group and defining $D_{EP}$ as the fractal dimension of the cement sheath pore morphology of the conditional control group;

measuring and evaluating a fractal dimension of cement sheath particle morphology with the alternating load, and measuring and evaluating a fractal dimension of the cement sheath particle morphology without the alternating load, comprising:

utilizing a scanning electron microscope to perform surface scanning on the SEM scanning samples of the blank group and the conditional control group prepared in the step 1, thereby obtaining SEM images of the cement sheaths of the blank group and control group at different magnifications;

utilizing a program based on Python+OpenCV to binarize the SEM images, thereby obtaining binary images at different thresholds, white areas in the binary images representing microscopic particles, and black areas in the binary images representing microscopic pores;

based on the true porosities $\varphi$ obtained by using the mercury intrusion method, taking the true porosities $\varphi$ as a control factor and using a threshold segmentation algorithm based on an edge strength to adaptively adjust thresholds of the binary images, and selecting target binary images which have same true porosities with the SEM scanning samples of the blank group and the conditional control group;

utilizing a Matlab program to calculate areas and perimeters of white areas in the target binary images;

utilizing an area-perimeter fractal model $Lg(A_{Gi})=D_G*Lg(P_{Gi})+C_G$ to draw the areas and perimeters of the white areas in the target binary images on the double logarithmic coordinate system, where $P_{Gi}$ represents an equivalent perimeter of a white geometric figure in the target binary images, $A_{Gi}$ represents an equivalent area of the white geometric figure with the equivalent perimeter $P_{Gi}$ in the target binary images, $D_G$ represents the fractal dimension of the cement sheath particle morphology, and $C_G$ represents a fractal model constant of cement sheath particles; and calculating the fractal dimension of the cement sheath particle morphology of each of the blank group and the conditional control group through a curve slope of $Lg(A_{Gi})=D_G*Lg(P_{Gi})+C_G$, defining $D_{BG}$ as the fractal dimension of the cement sheath particle morphology of the blank group and defining $D_{EG}$ as the fractal dimension of the cement sheath particle morphology of the conditional control group;

measuring and evaluating a fractal dimension of cement sheath crack morphology after actions of the alternating load, comprising:

utilizing the scanning electron microscopy to perform surface scanning on the SEM scanning sample of the conditional control group, thereby obtaining SEM images of the cement sheath of the conditional control group at different magnifications;

obtaining target binary images of cement sheath cracks;

utilizing a Matlab program to calculate a total number $N(\delta_{Fi})$ of square boxes with a side length $\delta_{Fi}$ covering the target binary images of the cement sheath cracks;

utilizing a box model $LgN(\delta_{Fi})=D_{EF}*Lg\delta_{Fi}+C_F$ to draw the side length $\delta_{Fi}$ and the total number $N(\delta_{Fi})$ of the square boxes on the double logarithmic coordinate system, where $D_{EF}$ represents the fractal dimension of the cement sheath crack morphology; $C_{EF}$ represents a fractal model constant of the cement sheath crack morphology; and calculating the fractal dimension $D_{EF}$ of cement sheath crack morphology of the conditional control group through a curve slope of $LgN(\delta_{Fi})=D_{EF}*Lg\delta_{Fi}+C_{EF}$;

building functional relationships $F_{B1}(S_{BR}, D_{BTF})$ and $F_{B2}(S_{BR}, D_{BCF})$ between the radial cementing strength of the casing-cement sheath interface of the blank group and the fractal dimensions of the casing-cement sheath interface morphology of the blank group;

building functional relationships $F_{B3}(Q_{BL}, D_{BP})$ and $F_{B4}(Q_{BC}, D_{BP})$ between the macroscopic mechanical properties of the cement sheath of the blank group and the fractal dimension of the cement sheath pore morphology of the blank group;

building functional relationships $F_{B5}(Q_{BL}, D_{BG})$ and $F_{B6}(Q_{BC}, D_{BG})$ between the macroscopic mechanical properties of the cement sheath of the blank group and the fractal dimension of the cement sheath particle morphology of the blank group;

building functional relationships $F_{E1}(S_{ER}, D_{ETF})$ and $F_{E2}(S_{ER}, D_{ECF})$ between the radial cementing strength of the casing-cement sheath interface of the conditional control group and the fractal dimensions of the casing-cement sheath interface morphology of the conditional control group;

building functional relationships $F_{E3}(Q_{EL}, D_{EP})$ and $F_{E4}(Q_{EC}, D_{EP})$ between the macroscopic mechanical properties of the cement sheath of the conditional control group and the fractal dimension of the cement sheath pore morphology of the conditional control group;

building functional relationships $F_{E5}(Q_{EL}, D_{EG})$ and $F_{E6}(Q_{EC}, D_{EG})$ between the macroscopic mechanical properties of the cement sheath of the conditional control group and the fractal dimension of the cement sheath particle morphology of the conditional control group;

building functional relationships $F_{E7}(Q_{EL}, D_{EF})$ and $F_{E8}(Q_{EC}, D_{EF})$ between the macroscopic mechanical properties of the cement sheath of the conditional control group and the fractal dimension of the cement sheath crack morphology;

utilizing the fractal dimensions $D_{BTF}$, $D_{BCF}$, $D_{BP}$, $D_{BG}$ and the functional relationships $F_{B1}(S_{BR}, D_{BTF})$, $F_{B2}(S_{BR}, D_{BCF})$, $F_{B3}(Q_{BL}, D_{BP})$, $F_{B4}(Q_{BC}, D_{BP})$, $F_{B5}(Q_{BL}, D_{BG})$ and $F_{B6}(Q_{BC}, D_{BG})$ to quantitatively evaluate the integrity of the cement sheath of the blank group; and utilizing the fractal dimensions $D_{ETF}$, $D_{ECF}$, $D_{EP}$, $D_{EG}$, $D_{EF}$ and functional relationships $F_{E1}(S_{ER}, D_{ETF})$, $F_{E2}(S_{ER}, D_{ECF})$ $F_{E3}(Q_{EL}, D_{EP})$, $F_{E4}(Q_{EC}, D_{EP})$, $F_{E5}(Q_{EL}, D_{EG})$, $F_{E6}(Q_{EC}, D_{EG})$, $F_{E7}(Q_{EL}, D_{EF})$ and $F_{E8}(Q_{EC}, D_{EF})$ to quantitatively evaluate the regularity of the damage evolution of the cement sheath of the conditional control group.

* * * * *